United States Patent [19]

Grob et al.

[11] 4,244,504

[45] Jan. 13, 1981

[54] APPARATUS FOR CONTROLLING THE MOVEMENT OF A WEB OF MATERIAL CONTINUOUSLY DELIVERED TO A MACHINE PROCESSING THE WEB

[75] Inventors: Jean Grob, Lausanne; Roger Roch, Cossonay, both of Switzerland

[73] Assignee: J. Bobst & Fils, S.A., Lausanne, Switzerland

[21] Appl. No.: 959,378

[22] Filed: Nov. 9, 1978

[30] Foreign Application Priority Data

Nov. 11, 1977 [CH] Switzerland ..... 013762/77

[51] Int. Cl.[3] ..... B65H 17/54; B65H 17/20; B65H 17/42

[52] U.S. Cl. ..... 226/114; 226/117; 226/118

[58] Field of Search ..... 226/168, 8, 114, 117, 226/118, 119, 177, 154, 155, 189, 187

[56] References Cited

U.S. PATENT DOCUMENTS

| | | | |
|---|---|---|---|
| 2,932,508 | 4/1960 | Tennler | 226/114 |
| 3,085,457 | 4/1963 | Fischer et al. | 226/114 X |
| 4,060,187 | 11/1977 | Grob | 226/8 |

FOREIGN PATENT DOCUMENTS

| | | | |
|---|---|---|---|
| 1061167 | 2/1967 | Fed. Rep. of Germany | 226/114 |

*Primary Examiner*—George F. Mautz

*Attorney, Agent, or Firm*—Hill, Van Santen, Steadman, Chiara & Simpson

[57] ABSTRACT

An apparatus for controlling the movement of a web of material, which is being continuously supplied to a machine which operates sequentially on a portion of the web as each portion is at a standstill, characterized by the apparatus including a feeder for feeding the web at a continuous rate of speed and a web take-up device for engaging the web as it exits the feeder to absorb the web being supplied by the feeder for a period of time that the portion of the web is being acted on by the machine and is in a stationary or standstill position. The web take-up device includes a pair of first members mounted in a pair of spaced side frames for rotation on a first axis, a web guide member having a second axis and a structure mounting the web guide member to extend between the pair of first members with the second axis being eccentric to the first axis. The structure for mounting the web guide members includes a control screw for varying the amount of offset of the second axis from the first axis, and a cam or lever arrangement for varying the angular position of the second axis during rotation of the pair of first members on the first axis. The take-up device also includes a device for compensating for the weight of the guide member including a second screw coupled to the first screw to move a counterweight during rotation of the first screw.

3 Claims, 5 Drawing Figures

APPARATUS FOR CONTROLLING THE MOVEMENT OF A WEB OF MATERIAL CONTINUOUSLY DELIVERED TO A MACHINE PROCESSING THE WEB

BACKGROUND OF THE INVENTION

1. Field of the Invention

The present invention is directed to a device for controlling the movement of a web of material being fed at a constant rate of speed through a web take-up device to a machine which acts on a portion of the web as the portion is at a standstill. The web take-up device includes a pair of first members mounted in a side frame for rotation on a first axis, a cylinder guide member for engaging a portion of the web and means for eccentrically mounting the guide member on the pair of first members so that it rotates about the first axis with the amount of offset or eccentricity being controlled by a control screw.

2. Prior Art

In one known method and apparatus for forming blanks utilizing a platen press, a web of material, for example paper board, is generally delivered to the platen press in a continuous manner. In view of the fact that the platen press is able to die cut a portion of the web if this portion is temporarily stopped or at a standstill, continuous feeding of the web causes the web to accumulate in front of the cutting station of the platen press. To overcome this problem of accumulation of the continuously moving web, several solutions have been suggested and tried out.

The most simple solution consists of forming a loop in the web prior to its introduction into the press. However, fluttering will occur in the loop and this solution has been found to be unsatisfactory when the production speed is increased and when the accuracy of the position of the web portion introduced into the platen press must be maintained in order to obtain a registry between the printing on the web and the die cut pattern.

Machine builders, therefore, imagined a way to check the formation of the web loop in such a way that the effect of fluttering on the web would be reduced to a very minimum at the point of entry to the machine by using a loop controlled device. For this purpose, an appliance was used which involved a web being lead around a circumferential portion of a roller which is mounted between two rotating members or plates with the axis of the roller being offset from the axis of rotation of the plates. German Patent No. 1,061,167 of July 6, 1957 is an example of this type of apparatus.

Another solution, which has been suggested, was disclosed in U.S. Pat. No. 4,060,187. However, the solution of this patent has various disadvantages with regard to the adherence of the broad web-like material on the roller when operating at high speeds, for example, with a linear web speed of up to 300 meters per minute. With a low traveling speed for the web, the web adherence on the revolving roller is good and the rotary motion of the offset roller corresponds to the web traveling motion. On the other hand, in the event of high speeds, the web begins to skid or slip on the revolving roller. Consequently, the curve represented by the angular motion of the revolving roller varies from the curve represented by the web travel and will therefore, in practice, lead to misregistry and increase the temporary stresses which interfere with the web traction. Thus, the use of the rotating roller has the consequence of subjecting the web to a heavy overload to cause misregistry of the pattern due to the stresses on the web. In addition, the rotating roller will generate a lot of noise which occurs from the web sliding on the roller and from the excessive pressure which must be exerted on the web in the area of the nip rollers which are being used to feed the web onto the web guide member between the pair of first members.

SUMMARY OF THE INVENTION

The present invention is directed to an improved apparatus for controlling the movement of the web which eliminates the problems that occurred in previously known apparatuses with regard to obtaining the registry of a pattern on the web with the machine acting on the web.

To accomplish these tasks, the apparatus for controlling the movement of the web of a material being continuously supplied to a machine, which operates sequentially on portions of the web with each portion being at a standstill or dwell while being operated on by the machine, said apparatus including a pair of spaced side frame members, means for feeding the web in one direction at a continuous rate of feed being disposed in the side frame members and including means for pulling and introducing the web of material, and a web take-up means for engaging the web of material and accumulating the web as the portion is at a standstill, said web take-up means comprising a pair of first members mounted in said pair of side frame members for rotation on a first axis, a web guide member extending between said pair of first members and having a second axis and a hub member with a sliding shoe disposed at each end thereof, means for mounting the web guide member and said pair of first members with the second axis being offset from the first axis, said means for mounting including means for varying the amount of offset of the second axis from the first axis and means for varying the angular position of the second axis relative to said pair of first members during a rotation of said pair of first members on said first axis, and means for compensating for the weight of the web member being mounted on each of said first members, said means for mounting including a support member mounted on each of the first members for relative rotation about the first axis, each support member having a first sliding guide for receiving the sliding shoe of the hub and a second sliding guide, said means for adjusting the axial position including a first screw member mounted for rotation in each of said support members with a thread member engaging the shoe and moving the shoe in said first sliding guide during rotation of the screw member, said means for compensating including a second screw member mounted on each of the first members and supporting a threaded counterweight, means for coupling the ends of the first and second screw members to rotate together and allow movement of the axis of the first screw member relative to the axis of the second screw member, said means for adjusting the angular position including a cam lever being pivotably mounted on each of the first members and having a second shoe received in the second sliding guide of the support and a follower engaging a cam mounted on the frame member, and said first members being rotated in a direction so that during initial take-up the web guide member is being moved eccentrically around the first axis in a direction which is the same as said one direction of feed for the web material.

Preferably, the web guide members comprise a cylindrical shell fixedly secured on the hub so that it is unable to rotate about the second axis and the means for coupling the first and second screw members which have opposite handed threads comprises a ball and socket universal joint.

DESCRIPTION OF THE PREFERRED EMBODIMENT

Figure 1:
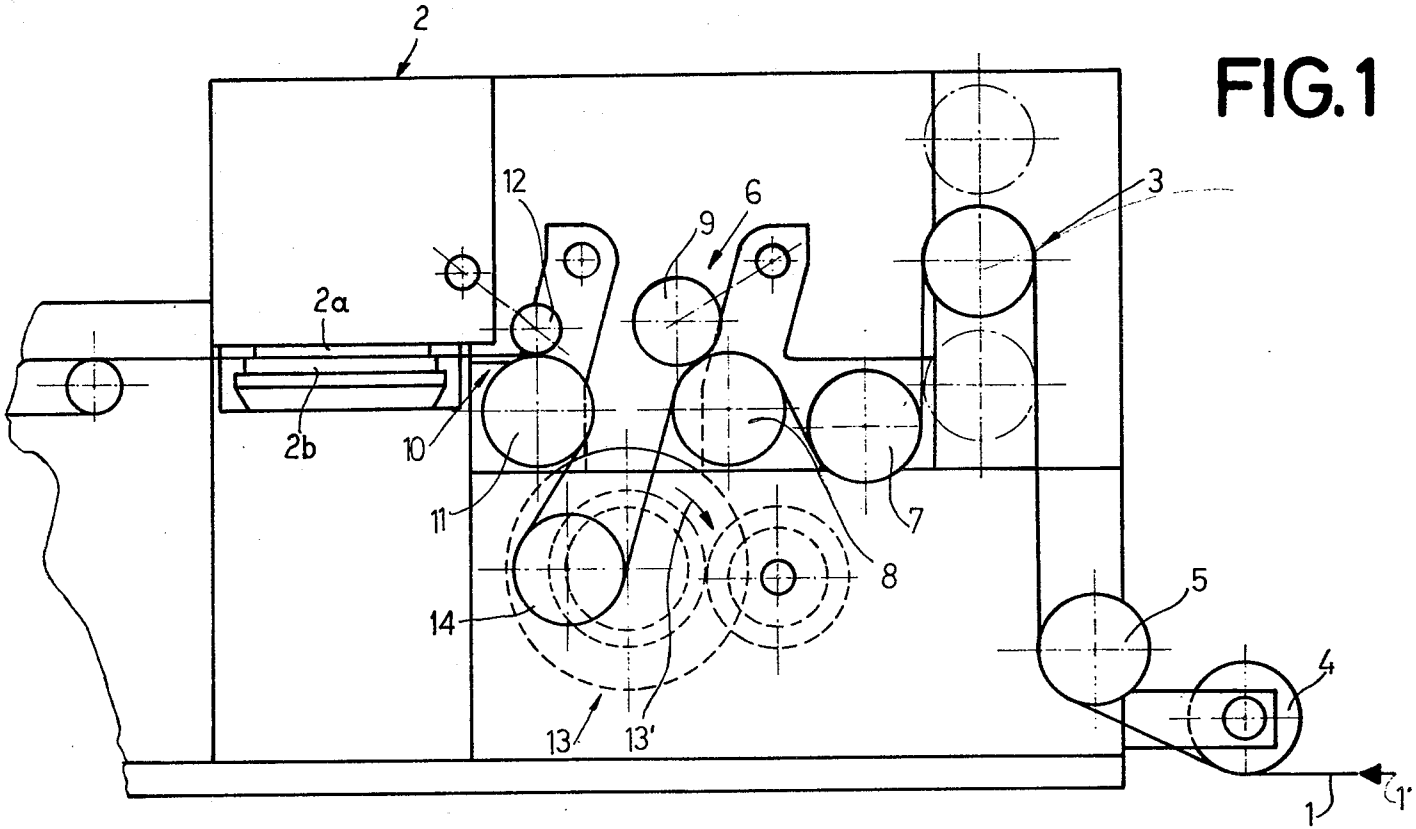
FIG. 1 is generally a schematic view of a web feeding device having a web take-up arrangement for controlling the movement of the web to a machine.

The principle of the present invention is particularly useful for controlling the movement of a web of material 1 as it is being continuously fed to a platen press generally indicated at 2 in FIG. 1. The press 2 operates on a portion of the web which is disposed between a pair of platens 2*a* and 2*b* of the press and is held at a standstill as the platens 2*a* and 2*b* engage the portion to operate thereon such as to die cut a blank therefrom.

The web of material originates in a preceeding station which is not illustrated and is moved in a direction of arrow 1' and is received by rollers 4 and 5 and lead to a web compensator generally indicated at 3. From the web compensator 3, the web 1 of material is passed around an idler roll 7 to a pulling appliance or unit generally indicated at 6. The pulling appliance 6 consists of a pull or driven roller 8 on which the web 1 actually travels and a pressure roller 9. From the pulling appliance 6, the web is continuously fed to an infeed unit or appliance generally indicated at 10. The infeed appliance 10 consists of a lower roller 11 operating with a circumferential speed slightly higher than the maximum traveling speed of the web 1 and includes an assembly of pressure rollers 12 which are capable of being lifted upon request so that the traction exerted on the web by the driven roller 11 can be neutralized. Disposed between the pulling device 6 and the infeed appliance or device 10, is a web absorption device or web take-up means generally indicated at 13 which includes a web guide member 14. The web take-up means 13 rotates in a direction of arrow 13' which is the same as the direction of feed 1' of the web 1 and absorbs or takes-up the moving web 1 during a predetermined period of time on which the portion being acted on by the platen press 2 is at a standstill to enable die cutting thereof.

Figure 2:
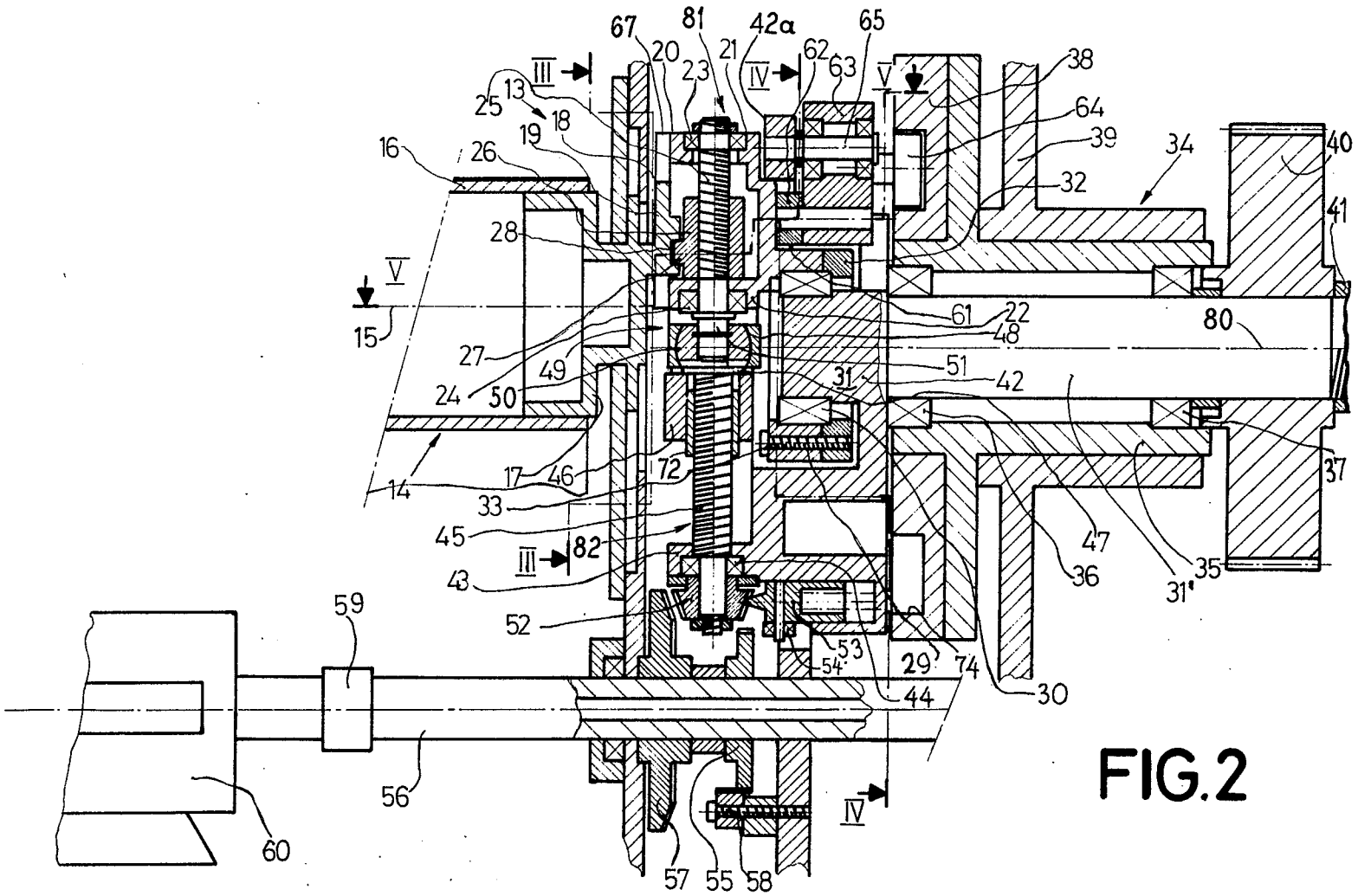
FIG. 2 is a cross-sectional view with portions in elevation of an end of the web guide member and the structure for mounting it in the device taken generally along an axis of the web guide member.

The structure of the absorption or take-up device 13 is best illustrated in FIG. 2 in which one half such as the right hand side of the device is illustrated and it should be remembered that the left hand side is exactly the same. The web take-up device 13 comprises a pair of first members 42 which are mouned for rotation on a first axis 80 by a bearing arrangement 34 in a side frame member such as 39. The web guide member 14 is mounted between the pair of rotating members 42 by means for mounting generally indicated at 81.

The web guide member 14 has a theoretical or second axis 15 and is mounted by means 81 with the axis 15 offset from the axis 80. As illustrated, the member 14 preferably comprises a cylindrical member or shell 16, which is secured at each end to a hub 17 so that it is unable to rotate about the second axis 15. The hub 17 contains a first sliding shoe 18 which has a groove 28.

Figure 5:
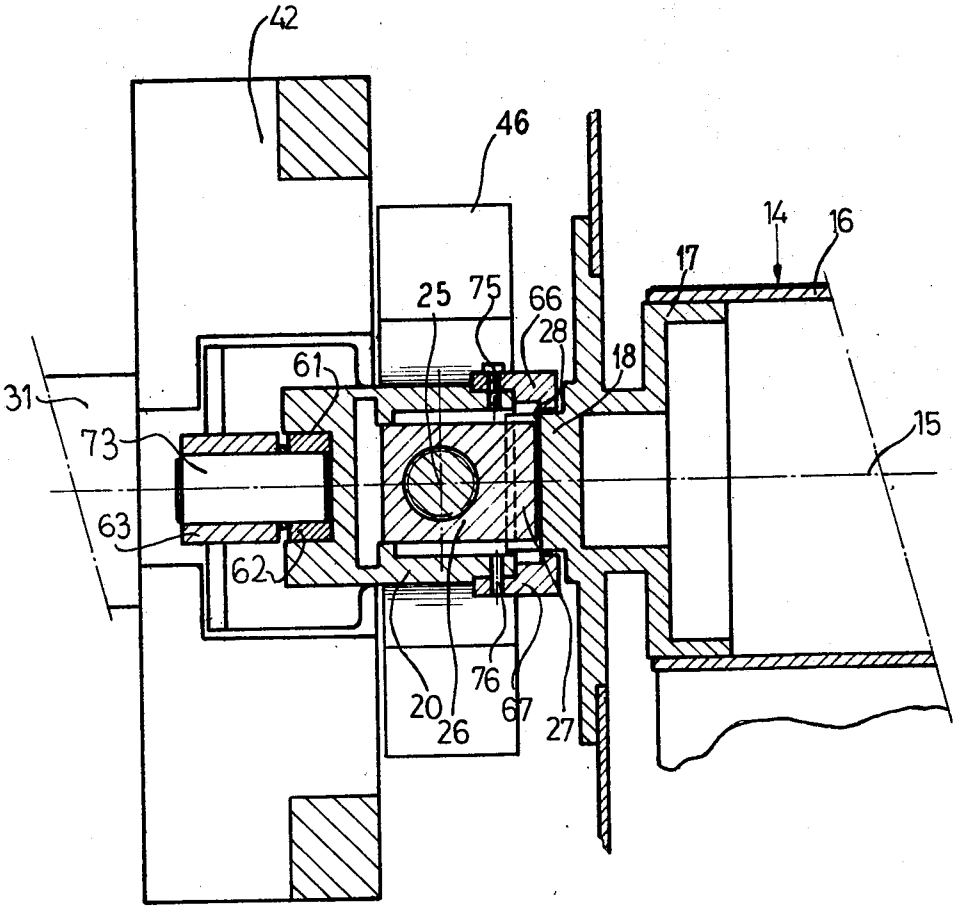
FIG. 5 is a cross-sectional view taken along lines V—V of FIG. 2.

The mounting means 81 includes a support 20, which has a hub portion 29 receiving a roller bearing 30 to mount the support 20 for rotation on an axial portion 31 of the first member 42. As best illustrated in FIG. 2, the roller bearing 30 is received in the hub 29 and held therein by a ring 32 which is secured to the hub by fasteners such as 33. The support 20 has bearing housings 21 and 22, which receive bearings 23 and 24, respectively, to rotatably support a first screw member 25, which, as illustrated, has right hand threads. The first screw member receives a threaded member 26, which has a protruberance or projection 27. Adjacent and extending along the same direction as the screw member 25, the housing 20 has a first sliding guide or groove 19 which, as best illustrated in FIG. 5, is formed by bars 66 and 67 which are secured on the housing 20 by fasteners 75 and pins 76 and a second sliding guide or groove 61. The groove or first sliding guide 19 receives the sliding shoe 18 of the hub 17 and the groove 28 of the shoe receives the projection or protruberance 27 so that as the threaded member or nut 26 is moved axially along the first screw member 25, the shoe 18 is moved along the guide 19. Thus, the screw, threaded member and guide form means for adjusting the amount of eccentricity of the second axis 15 relative to the first axis 80.

To rotate the first member 42, it is provided with a device shaft 31' which is illustrated as being integral with the member 42. The drive shaft 31' cooperates to mount the first member 42 in the side frame 39 and utilizes the bearing arrangement generally indicated at 34. The bearing arrangement 34 has a tubular housing 35 which receives roller bearings 36 and 37 and maintains them with the desired axial spacing. The roller bearings 36 and 37 rotatably support the shaft 31' in the tubular housing 35 which is slidably received in a hub of the side frame member 39. In addition, the tubular housing 35 is illustrated as being provided with a flange on which a circular cam member 38, which has facing double cam surfaces formed by a groove 74 (best illustrated in FIG. 4), is mounted such as by bolts, not illustrated. To rotate the shaft 31', a drive pinion 40 is keyed on the drive shaft and held in spaced relationship against the inner race of the ball bearing 37 by a nut 41.

Figure 4:
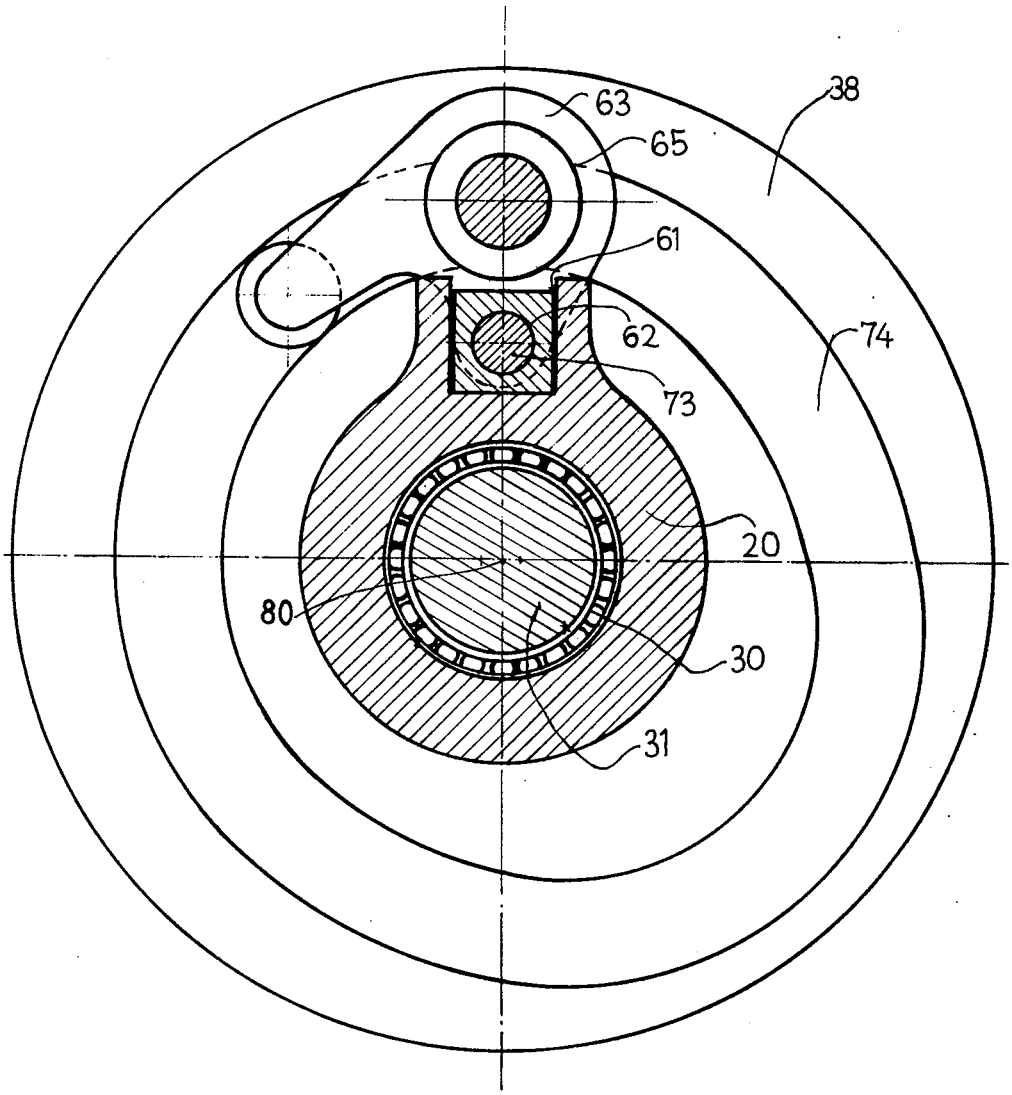
FIG. 4 is a cross-sectional view taken along lines IV—IV of FIG. 2.

The mounting means 81 also includes means for shifting the angular position of the second axis 15 relative to the first member 42 during rotation of the first member on the axis 80. As illustrated, this means includes the second guide groove 61 best illustrated in FIG. 4 which receives a guide shoe 62 which is rotatably mounted on a cam lever 63 by a pin or shaft 73 (FIG. 4). The cam lever 63 is mounted for rotation by bearings on a pin or shaft 65 extending from a portion 42*a* (FIG. 2) of the first member 42. In addition, as best illustrated in FIG. 4, the cam lever 63 has a follower 64 which is received between the double acting cam surfaces formed by the groove 74 of the cam member 38. Thus, during rotation of the second member the follower 64 moving between the double acting cam surfaces 74 will cause the lever 63 to pivot on the shaft 65. This pivotable movement of the lever 63 causes the shoe 62 received in the second guide groove 61 to rotate the housing 20 on the portion 31 relative to the member 42 to change the angular position of the second axis 15 to the member 42.

As best illustrated in FIG. 2, the first member 42 also supports means generally indicated at 82 for compensating for the weight of the guide member 14. As illustrated, the means 82 for compensating includes a bearing housing 43 extending from member 42 and receiving a roller bearing 44 that supports a second half screw 45 which has left handed threads and supports a counterweight 46 by a threaded bushing such as 72. The first screw member 25 and the second screw member 45 are interconnected by means for coupling 49 which means transfers the rotational force of one screw member such as 45 to the other screw member such as 25 yet allows movement of the axis of the screw member 25 relative to the axis of the screw member 45. As illustrated, the means 49 is a ball and socket type universal connection in which the outer socket 48 is attached to a flange 47 of the second screw member 25 and the ball portion 50 is pinned to an end 51 of the first screw member 25. While not illustrated, means are provided between the ball 50 and the socket 48 so that rotation of the socket causes rotation of the ball yet allows relative angular movement between the axes of the two screw members.

Figure 3:
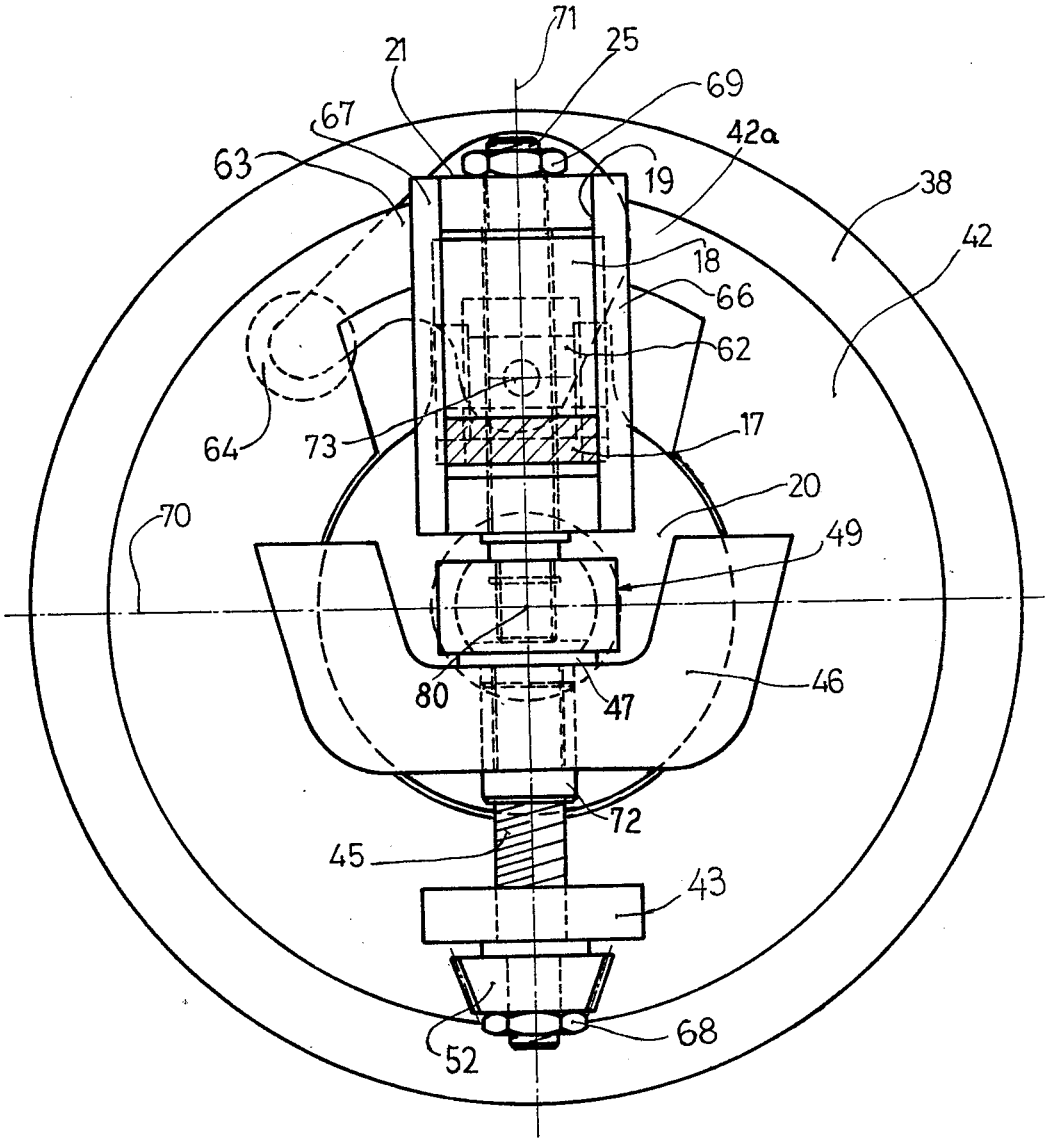
FIG. 3 is a cross-sectional view taken along lines III—III of FIG. 2.

In order to drive or rotate the screw members 45 and 25, the second screw member 45 is provided with a beveled or tapered pinion 52, which is keyed on the end of the second screw member 45 and held by a nut 68 (FIG. 3). Adjacent the beveled gear 52, the rotatable member 42 has a bore slidably receiving a gear stop 43 which is urged by a spring (not illustrated) into engagement with the teeth of the beveled gear or tapered pinion 52. The gear stop 53 is provided with a roller bearing 54, which will be engaged by a pinion 55 which is keyed to a shaft 56 when the shaft 56 is shifted in a right hand direction as illustrated in FIG. 2. Keyed on the shaft 56 is a drive pinion or a tooth beveled gear 57 which will engage the beveled gear 52 as the gear 55 disengages the gear stop 53. It is noted that during axial shifting, the gear 55 will be released from a lock 58. To shift the axle 56, a coupling 59, which includes an electromagnetic shifting system will shift a collar and the shaft 56 in a manner similar to the one used, for example, in the gear box from the engaged position illustrated to a disengaged position so that a step-by-step motor or stepping motor 60 can rotate the shaft to rotate both of the screws 45 and 25 to simultaneously change the eccentric distance of the second axis 15 of the guide member 14 relative to the first axis 80 and the portion of weight 46.

As best illustrated in FIG. 3, the first screw member or half screw 25 is secured in the housing by a nut such as 69. The coupling 49, which is a type of universal joint, which does not alter the rotating speed, is arranged with its center at the intersection of a vertical axis 71 of the second screw member 45 and a horizontal axis 70 which axes also passes through the first axis 80 of the member 42. Thus, while both of the threaded screw members 25 and 45 can be arranged with their axis on the vertical axis 71, movement of the cam lever in a clockwise direction around the mounting pins 65 (FIG. 4) will cause the axis of the first screw member 25 to be pivoted around axis 80 in a counterclockwise direction as illustrated in FIG. 3.

In operation, the web guide 14 will rotate around the first axis 80 with a speed that will be substantially the same as the speed of movement of the web 1 if the two first members are rotated in a clockwise direction as illustrated in FIG. 1.

It should be noted that first member 42 is provided with a cut out portion to receive the support 20 and also to receive the cam lever 63. Also a portion of the hub 29 of the support 20 is cut away to provide clearance for cam lever 63.

An advantage of this structure is the fact that the inertia of the web guide member 14 no longer has an influence on the stresses exerted on the web-like material 1 for which reason the tension existing on the section arriving at the web guide member 14 is basically the same as the tension existing on the portion leaving the guide 14. Thus, all problems with registry between a pattern on the web 1 and the platens of the press are eliminated. In connection with this a relatively slight functional shift will appear. This is arranged so that it occurs to reduce the wrap around angle of the web 1 around the web guide member 14 when the web 1 comes to a standstill between the cutting dies of the platen press.

Although various minor modifications may be suggested by those versed in the art, it should be understood that we wish to embody within the scope of the patent warranted hereon, all such modifications as reasonably and properly come within the scope of our contribution to the art.

We claim:

1. An apparatus for controlling the movement of a web of material being continuously supplied to a machine which operates sequentially on portions of the web with each portion being at a standstill while being operated on by the machine, said apparatus including a pair of spaced side frame members, means for feeding the web in a direction at a continuous rate of feed being disposed in the side frame members and including means for pulling and introducing the web of material, and a web take-up means for engaging the web of material and accumulating the web as the portion is at a standstill, said web take-up means comprises a pair of first members mounted in said pair of side frame members for rotation on a first axis, a web guide member extending between said pair of first members and having a second axis and a hub member with a sliding shoe disposed at each end thereof, means for mounting the web guide member in said pair of first members with the second axis being offset from the first axis, said means for mounting including means for varying the amount of offset of the second axis from the first axis and means for varying the angular position of the second axis relative to said pair of first members during rotation of said pair of first members on the first axis, and means for compensating for the weight of the web guide member being mounted on each of said first members, said means for mounting including a support member mounted on each of the first members for relative rotation about the first axis, each support member having a first sliding guide for receiving the sliding shoe of the hub and a second sliding guide, said means for adjusting the axial position including a first screw member mounted for rotation in each of said support members with a thread member engaging the shoe and moving the shoe in said first sliding guide during rotation of the screw member, said means for compensating including a second screw member on each of the first members and supporting a threaded counterweight, means for coupling the ends of the first and second screw members to rotate together and allow movement of the axis of the first screw member relative to the axis of the second screw member, said means for adjusting the angular position including a cam lever pivotably mounted on each of the first members having a second shoe received in the second sliding guide of the support and a follower engaging a cam mounted on the side frame member, and said first members being rotated in a direction so that during the initial take-up the web guide member is being moved about eccentrically around the first axis in a direction which is the same as said one direction of feed for the web material.

2. An apparatus according to claim 1, wherein the web guide member comprises a cylindrical shell fixedly secured to the hubs so that it is unable to rotate about the second axis.

3. An apparatus according to claim 2 wherein the means for coupling includes a type of universal joint which does not alter the rotating speed.

* * * * *